United States Patent [19]

Takagi et al.

[11] Patent Number: 4,745,333

[45] Date of Patent: May 17, 1988

[54] AUXILIARY ELECTRODES IN FLUORESCENT LAMPS FOR PREVENTING IRREGULAR LIGHT FLICKERING

[75] Inventors: Masami Takagi; Toshiharu Yagi, both of Yokosuka; Masao Kawaziri, Kanuma, all of Japan

[73] Assignee: Kabushiki Kaisha Toshiba, Kawasaki, Japan

[21] Appl. No.: 934,853

[22] Filed: Nov. 25, 1986

[30] Foreign Application Priority Data

Nov. 29, 1985 [JP] Japan ..... 60-267335

[51] Int. Cl.[4] ..... H01J 61/067; H01J 61/10

[52] U.S. Cl. ..... 313/492; 313/632

[58] Field of Search ..... 313/491, 492, 631, 632

[56] References Cited

U.S. PATENT DOCUMENTS 4,024,423 5/1977 Kern ..... 313/492 X

*Primary Examiner*—David K. Moore

*Assistant Examiner*—K. Wieder

*Attorney, Agent, or Firm*—Cushman, Darby & Cushman

[57] ABSTRACT

A fluorescent lamp includes a bulb defining a discharge channel, and a pair of discharge electrodes provided at both ends of the bulb. Each electrode has a pair of leads, a filament mounted between the leads, and rod-like auxiliary electrodes protruding from the leads, respectively. Each auxiliary electrode extends beyond the filament in the electron discharge direction of the discharge electrodes. Each auxiliary electrode is constructed so as to satisfy the following equation $Q/I_L \geqq 1.0 \times 10^{-2}$, where Q is heat capacity of the auxiliary electrode and $I_L$ is lamp current.

8 Claims, 3 Drawing Sheets

AUXILIARY ELECTRODES IN FLUORESCENT LAMPS FOR PREVENTING IRREGULAR LIGHT FLICKERING

BACKGROUND OF THE INVENTION

This invention relates to a fluorescent lamp, and more particularly to a fluorescent lamp having auxiliary electrodes for preventing irregular light flickering and early blackening.

When a fluorescent lamp is operated by an AC power source, variation of the radiated light from the fluorescent lamp is sometimes observed. The variation of the radiated light, or flickering, is classified into two types of flickering; one is a regular flickering occurring in accordance with the frequency of the AC power source of the lamp, and the other is irregular flickering in which luminance irregularly varies independent of the frequency. The irregular flickering is annoying to the user. The irregular flickering is known to occur when the anode vibration irregularly repeats in the fluorescent lamp. Especially when the lamp has been operated 1,000 hours or over, the irregular flickering occurs more frequently.

In general, a fluorescent lamp has a pair of discharge electrodes, each of which includes a pair of leads, and an electrode filament made of tungsten coil bridging the paired leads. For preventing the irregular flickering, there is known a measure using auxiliary electrodes protruding from the leads. The measure can successfully solve the problem of irregular flickering. However, this effect of the flickering prevention does not last till the life of the fluorescent lamp expires. The possibility of reoccurrence of the annoying irregular flickering still remains. Some of the fluorescent lamps thus constructed are blackened near the electrodes comparatively early in life, resulting in shorter life.

SUMMARY OF THE INVENTION

In view of the above disadvantages, it is an object of this invention to provide a fluorescent lamp which is free from irregular flickering and blackening over a long period of time.

To achieve the above object, in a fluorescent lamp according to this invention, each discharge electrode includes a pair of leads supporting a filament, and rod-like auxiliary electrodes protruding from each lead. Each auxiliary electrode is so constructed that it protrudes over the filament in the direction of electron discharge. Further, the heat capacity Q of the auxiliary electrode and the lamp current IL has a ratio of $Q/I_L > 1.0 \times 10^{-2}$.

With such an arrangement, sputtering and generation of gas due to excessive temperature rise of the auxiliary electrodes can be prevented. As a result, blackening is prevented, thus prolonging the life of the fluorescent lamp. The function of preventing flickering by the auxiliary electrodes can be maintained over a long period of time.

BRIEF DESCRIPTION OF THE DRAWINGS

FIGS. 1 through 3 show a fluorescent lamp according to an embodiment of the present invention, in which FIG. 1 is a partially broken side view of the fluorescent lamp, and FIGS. 2 and 3 are enlarged front and side views of a discharge electrode;

DETAILED DESCRIPTION OF THE PREFERRED EMBODIMENTS

Embodiments of this invention will now be described with reference to the accompanying drawings.

Figure 1:
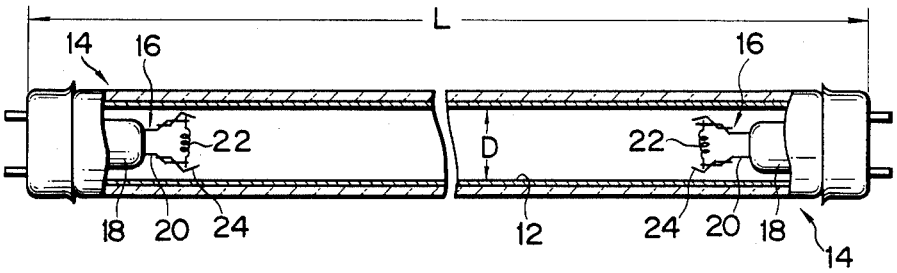

As shown in FIG. 1, a fluorescent lamp comprises straight-tube type bulb 10 which defines a discharge path. The inner surface of bulb 10 is coated with fluorescent material. The coated material forms coating 12. Mounts 14 are hermetically fitted to both ends of bulb 10. Discharge electrode 16 is mounted on each mount 14. Electrons are discharged from one electrode 16 to the other and vice versa, along the axis of bulb 10.

Figure 2:
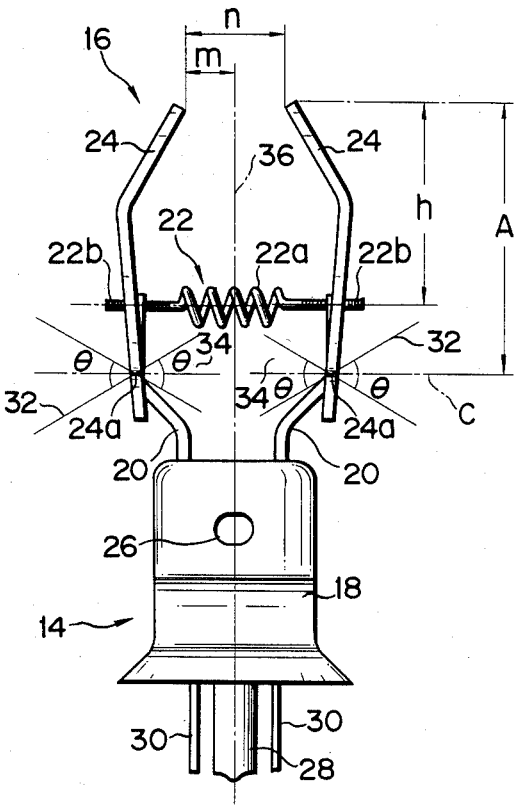
Figure 3:
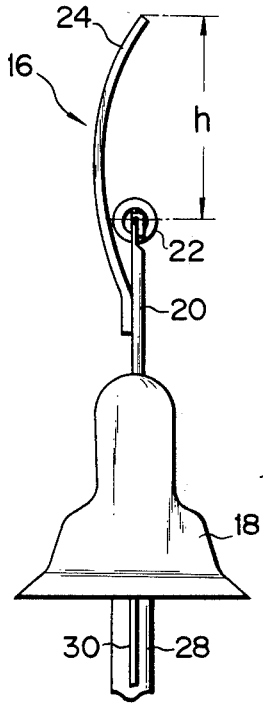

As shown in FIGS. 2 and 3, electrode 16 includes a pair of leads 20 protruding into bulb 10 from stem 18 of mount 14, and a coil filament bridging the pair of leads and extending normal to the axis of bulb 10. Filament 22 includes coated portion *22a* coated with electron-emitting material, and uncoated portions *22b* located at both ends of the coated portion. These uncoated portions respectively are fixed to leads 20. Further, rod-like auxiliary electrode 24 is electrically welded to the mid-portion of each lead 20 and extends beyond filament 22 in the direction of electron discharge of electrode 16. In FIGS. 2 and 3, numeral 26 designates an exhaust hole communicating with exhaust bulb 28, and numeral 30 designates a pair of external leads electrically connected to leads 20.

Assuming that the overall length of each auxiliary electrode 24 in the discharge direction, or along the axis of bulb 10 is A (mm), and that the portion protruding over filament 22 is h (mm) is length, $h > 4$ mm. Also, assuming that the heat capacity of the portion of auxiliary electrode extending from position *24a* fixed to lead 20 up to the top of the protruded portion is Q (cal/°C.), and the lamp current of the fluorescent lamp is $I_L$ (A), then the auxiliary electrode is so constructed as to have a ratio of $Q/I_L > 1.0 \times 10^{-2}$.

Experiment was conducted by the inventors in the present application, in which the occurrence rate of flickering and blackening of bulb were investigated by changing variously the values of length "h" and $Q/I_L$ of various fluorescent lamps. Table 1 shows various conditions for the fluorescent lamps, which were employed in this experiment. Type A in Table 1 is a straight-tube type fluorescent lamp with a bulb diameter of 28 mm, bulb length of 580 mm and power consumption of 18 W. Type B is a circular-tube type fluorescent lamp with a bulb diameter of 29 mm, inner diameter of 167 mm, outer diameter of 226 mm and power consumption of 28 W.

TABLE 1

| Bulb type | $I_L$(A) | Conditions of auxiliary electrode: Material | Diameter $\phi$ (mm) | h (mm) | Q | $Q/I_L$ | Trial No. |
|---|---|---|---|---|---|---|---|
| FL20 SS/18 | 0.34 | Nickel-plated iron wire (FEX) | 0.5 | 10 | $3.24 \times 10^{-3}$ | $9.53 \times 10^{-3}$ | I |
| | | | 0.5 | 13 | $3.80 \times 10^{-3}$ | $11.2 \times 10^{-3}$ | II |
| | | Nickel wire (FNI) | 0.5 | 10 | $3.66 \times 10^{-3}$ | $10.8 \times 10^{-3}$ | III |
| FCL 30/28 | 0.62 | Nickel-plated iron wire (FEX) | 0.5 | 10 | $3.24 \times 10^{-3}$ | $5.23 \times 10^{-3}$ | IV |
| | | | 0.5 | 13 | $3.80 \times 10^{-3}$ | $6.13 \times 10^{-3}$ | V |
| | | | 0.8 | 10 | $8.32 \times 10^{-3}$ | $13.4 \times 10^{-3}$ | VI |

Table 2 shows the experimental results of occurrence rates of flickering and blackening of the bulbs for various operating hours, using the trial lamps. Symbol o in Table 2 indicates a lamp which had the occurrence rate of flickering of 0%, Δ a lamp with the occurrence rate 1% or less 1%, and × a lamp with the occurrence rate higher than 1%. Symbol "a" indicates a lamp not blackened, "b" a lamp with slight blackening, "c" a lamp with blackening of about 50%, "d" a lamp remarkably blackened, and "—" a burned-out lamp as the life expired.

TABLE 2

| Test item | Operating hours: 500 H Flickering | 500 H Blackening | 1000 H Flickering | 1000 H Blackening | 2000 H Flickering | 2000 H Blackening | 5000 H Flickering | 5000 H Blackening | 7500 H Flickering | 7500 H Blackening |
|---|---|---|---|---|---|---|---|---|---|---|
| I | o | a | o | a | Δ | b | o | c | o | c |
| II | o | a | o | a | o | a | o | b | o | c |
| III | o | a | o | a | o | a | o | b | o | c |
| IV | o | a | Δ | b | Δ | c | o | d | — | — |
| V | o | a | Δ | b | Δ | c | o | d | — | — |
| VI | o | a | o | a | o | a | o | b | o | c |
| Without auxiliary electrodes | Δ | a | x | a | x | a | Δ | b | Δ | c |

From Tables 1 to 2, it is seen that $Q/I_L$ greatly influences the flickering and blackening of the fluorescent lamp, and that the boundary which ensures reliable reduction of the flickering and blackening is in the range of $Q/I_L = 1.0 \sim 1.1 \times 10^{-2}$. Theoretically, it is thought that the length "h" has some effect on the light flickering.

Figure 4:
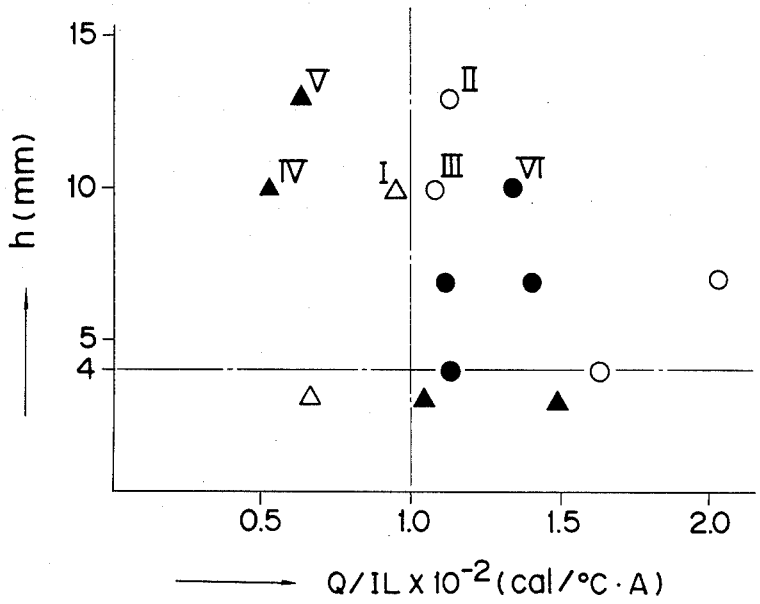
FIGS. 4 and 5 are views respectively showing an occurrence rate of flickering, and blackening occurrence of fluorescent lamps under various conditions.

Many experiments were additionally conducted using types A and B, in order to find the border values for both "h" and $Q/I_L$. FIG. 4 shows the results of the flickering occurrence tests. In FIG. 4, the abscissa represents $Q/I_L$ (cal/°C.) and the ordinate "h" (mm). Lamps which did not at all flicker till the life expired were classified as good. These "good" lamps are designated by symbol o for type A and ● for type B. Lamps whose occurrence rates were more than 1% were classified as no-good and designated by Δ for type A and ▲ for type B. These data plotted in FIG. 4 include some of the data as collected of the trial lamps in Table 1.

Figure 5:
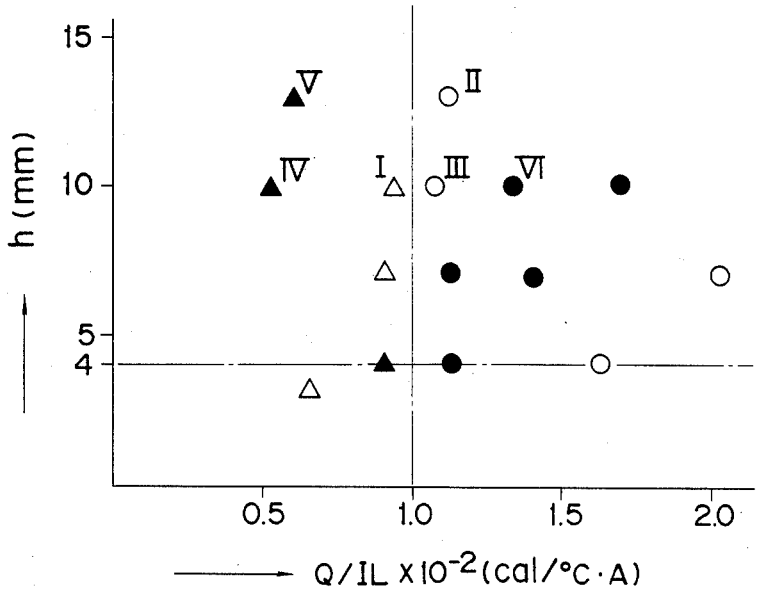

FIG. 5 shows the results of blackening tests. In FIG. 5, the abscissa of the coordinates represents ratio $Q/I_L$ (cal/°C.), the ordinate length "h" (mm). Lamps which had not been blackened after first 2,000 hours and still were not blackened at all, or blackened slightly (b degree) till the lifetime of 5,000 hours were classified as good. These "good" lamps are designated by a symbol o for type A and ● for type B. Lamps which had been blackened in the slightest after first 2,000 hours, and lamps blackened to a medium degree (c degree) or more till the lifetime of 5,000 hours were classified as no-good, and are designated by Δ for type A and ▲ for type B.

It is seen from FIGS. 4 and 5 that the lamps which have "h" of 4 mm or more and $Q/I_L$ of $1.0 \times 10^{-2}$ (cal/°C.) or more are all good, for both flickering and blackening. On the other hand, it is also found that the lamps, which have smaller values for both "h" and $Q/I_L$ than the above values, had less prevention of flickering. These lamps do not prove effective against blackening, either. The most preferable results were obtained for auxiliary electrodes of length "h" of 13 mm and $Q/I_L$ of $11.2 \times 10^{-2}$, made of nickle-plated iron wire.

From the results of the above experiments, it can be seen that if the auxiliary electrode is constructed to have $h > 4$ (mm) and $Q/I_L > 1.0 \geqq 10^{-2}$ (cal/°C.), the flickering preventing effect of the auxiliary electrode is satisfactorily maintained throughout the lifetime of the fluorescent lamp and early blackening of the bulb can be prevented.

It is also understood from the results of the above experiments that as the value of "h" is greater, the heat capacity of the auxiliary electrode increases, thus improving the flickering and blackening preventing effects. However, if "h" is too great, the distance between two electrodes 16 is shortened, decreasing the electron discharge area, or the light-emitting area of the fluorescent lamp. As a result, the lamp will give off less light. Therefore, it is desirable that the length "h" of auxiliary electrode 24 be set to $h \leqq L \times 0.035$, where L is the length of bulb (mm).

As shown in FIG. 2, the proximal end portion of each auxiliary electrode 24 protrudes in a predetermined direction from the fixing position 24*a* to lead 20. More specifically, the proximal end portion of each auxiliary electrode 24 protrudes in the direction along a line passing through the edge of virtual cone 32 (34) having center line C parallel to the axis of filament 22, an apex at fixing point 24*a*, and vertical angle $\theta$ of 60°, or along a line passing out of the virtual cones.

The experiment made by the inventors showed that if the auxiliary electrode protrudes in a direction passing through virtual cone 32 (34), the following problem arises. During the sealing process of the lamp manufacturing, when mount 14 is inserted into bulb 10 with fluorescent coating, it is more likely that auxiliary electrodes contact with the fluorescent coating and make scratches on the coating. Further, auxiliary electrodes are set close to the inner surface of the bulb. It is more likely that electrode material sputters during discharge, and blackening the bulb tends to occur.

It is preferable that the distance "m" between the extended end of each auxiliary electrode and the center axis of bulb 10 and the distance "n" between the pair of the extended ends be set to $m \leqq D \times 0.21$ and $n = 2$ m, respectively, where D is the diameter of the bulb. When this is done, the concentrated flow of electrons into filament 22 can be prevented.

It is desirable that each auxiliary electrodes 24 is distant from coated portion 22*a* of filament 22 by 2 mm or more, and from uncoated portions 22*b* by 0.5 mm or more. If so, during discharge, auxiliary electrodes will never be heated excessively by filament 22. Nor will the auxiliary electrodes be eroded by CO gas generated when the electron-emitting material coated on the filament is activated.

Moreover, it is desirable that auxiliary electrode 24 is apart from the inner surface of bulb 10 by 3 mm or more. If the distance between auxiliary electrode 24 and the inner surface of bulb 10 is less than 3 mm, the blackening of the bulb tends to occur due to the sputtering of the material forming the auxiliary electrode.

As described above, according to this embodiment, the auxiliary electrode is constructed to have $h \geqq 4$ mm, thus increasing the anode area of the electrode. Accordingly, even if the electrode is partially eroded by the sputtering of the filament or by the discharge of impure gas contained in the lamp material during the lamp is operated, the sufficient anode area of the electrode can be secured. This enables the flickering preventing effect of the auxiliary electrodes to be maintained over a long period of time. Also, with such a construction as to satisfy $Q/I_L \geqq 1.0 \times 10^{-2}$ (cal/°C. A), the excessive heat of the auxiliary electrode when electron flows into it, can be prevented, thus preventing the discharge of impure gas and sputtering. Therefore, it can be prevented that the compounds of impure gas and mercury, and sputtered material adhere to the the inner surface of the bulb to blacken the bulb, or these compounds or sputtered material adhere to the surfaces of the auxiliary electrodes and leads. As a result, shorting of life of the fluorescent lamp due to blackening and degradation of effect of flickering prevention are prevented.

This invention is not limited to the embodiment described above, and various changes and modification may be effected therein without departing from the scope of this invention.

Figure 6:
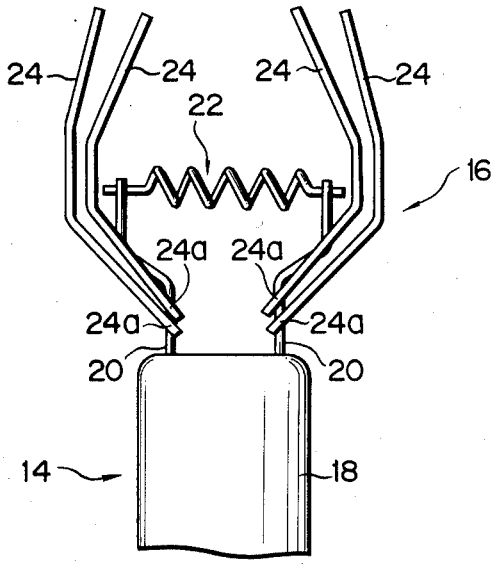
FIG. 6 is a front view showing a modification of this invention.

For example, as shown in FIG. 6, a plurality of auxiliary electrodes 24, for example, two, may be used for one lead 22. In this case, it is desirable that the size and the arrangement of each auxiliary electrode 24 may be the same as those in the first embodiment. In the second embodiment, the heat capacity Q is the total heat capacity of all the auxiliary electrodes that are fixed on one lead 20.

In this embodiment thus constructed, the same function and advantages can be obtained as in the first embodiment.

Further, this invention can be applied to not only straight-tube type but also other types of fluorescent lamps, such as circular-tube type fluorescent lamps and bend fluorescent lamps.

What is claimed is:

1. A fluorescent lamp comprising:

a bulb with two ends and defining a discharge path which extends between the ends; and a pair of discharge electrodes provided at both ends of said bulb, for discharging electrons to and from each other, at least one of said discharge electrodes including a pair of leads protruding in the discharge path substantially along an axial direction of the bulb, a filament mounted between the leads, and rod-like auxiliary electrodes protruding from the leads, respectively, each of said auxiliary electrodes protruding beyond the filament substantially along the axial direction of the bulb, and said auxiliary electrodes being constructed so as to satisfy the following equation $$Q/I_L \geqq 1.0 \times 10^{-2}$$

where

Q: heat capacity of the auxiliary electrode (cal/°C.)

$I_L$: lamp current (A).

2. A fluorescent lamp according to claim 1, wherein each of said auxiliary electrodes protrudes beyond the filament by appoximately 4 mm or more.

3. A fluorescent lamp according to claim 2, wherein the length "h" of the portion of each of said auxiliary electrodes protruding over the filament is within the range of 4 (mm) $\leqq h \leqq L \times 0.035$ (mm), where L stands for the axial length of said bulb.

4. A fluorescent lamp according to claim 3, wherein each of said auxiliary electrodes is made of nickel-plated wire with diameter of 0.5 mm, and the length "h" is set to be approximately 1.3 mm.

5. A fluorescent lamp according to claim 1, wherein said auxiliary electrodes are apart from an inner surface of the bulb by 3 mm or more.

6. A fluorescent lamp according to claim 1, wherein each of said auxiliary electrodes has a protruded end; the protruded end is arranged apart from a center axis of the bulb by $m \leqq D \times 0.21$, where m is the distance between said center axis and said protruded end, and D is the internal diameter of the bulb, and the pair of protruded ends are located apart from each other by 2 m.

7. A fluorescent lamp according to claim 1, wherein said filament includes an electron-emitting portion, and end portions located at both sides of said emitting portion and fixed to said leads; said auxiliary electrodes are arranged apart from said emitting portion by 2 mm or more and, from said end portions by more than 0.5 mm.

8. A fluorescent lamp according to claim 1, wherein each of said discharge electrodes includes other auxiliary electrodes protruding from said leads; each of said other auxiliary electrodes protrudes over the filament by 4 mm or more, and total Q of the heat capacity of all of said auxiliary electrodes protruding from one lead is set so as to satisfy $Q/I_L \geqq 1.0 \times 10^{-2}$.

* * * * *